US006761565B2

(12) United States Patent
Ito et al.

(10) Patent No.: US 6,761,565 B2
(45) Date of Patent: Jul. 13, 2004

(54) ELECTROMAGNETIC MECHANISM

(75) Inventors: Kenichi Ito, Chitagun (JP); Madoka Inami, Kariya (JP); Shigeki Niimi, Kariya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/278,819

(22) Filed: Oct. 24, 2002

(65) Prior Publication Data

US 2003/0087536 A1 May 8, 2003

(30) Foreign Application Priority Data

Oct. 24, 2001 (JP) ..... 2001-326780

(51) Int. Cl.[7] ..... H01R 11/30
(52) U.S. Cl. ..... 439/38; 439/305; 439/950
(58) Field of Search ..... 439/38, 305, 950, 439/87

(56) References Cited

U.S. PATENT DOCUMENTS 3,214,722 A * 10/1965 Weimer, Jr. ..... 439/441
4,019,796 A * 4/1977 Issler et al. ..... 439/39
4,513,785 A * 4/1985 Kenny ..... 137/881
4,720,078 A * 1/1988 Nakamura et al. ..... 251/129.15
5,211,682 A * 5/1993 Kadowaki et al. ..... 123/531
5,278,353 A * 1/1994 Buchholz et al. ..... 174/84 R
5,727,532 A * 3/1998 Everingham et al. ..... 123/520
6,095,490 A * 8/2000 Nakano et al. ..... 251/129.17
6,102,364 A * 8/2000 Busato ..... 251/129.05
6,273,122 B1 * 8/2001 Schudt et al. ..... 137/315.03
6,293,830 B1 * 9/2001 Park et al. ..... 439/801
6,565,020 B1 * 5/2003 Fischer et al. ..... 239/585.1

FOREIGN PATENT DOCUMENTS

JP 2001-143925 11/1999

* cited by examiner

*Primary Examiner*—Michael C. Zarroli
(74) *Attorney, Agent, or Firm*—Reed Smith LLP; Stanley P. Fisher, Esq.; Juan Carlos A. Marquez, Esq.

(57) ABSTRACT

An electromagnetic valve comprises a coil wound on a bobbin made of resin, a case accommodating the coil inside thereof and made of magnetic material, a yoke made of magnetic material and forming a magnetic circuit together with the case, a plunger made of magnetic material and driven by a magnetic attracting force generated at the energization of the coil, a connector formed separately from the bobbin and the case and connected to one end of the case, a first terminal passed into the connector, a second terminal electrically connected to an end of the coil and a urging member made of electric conductor and contacted with the first and second terminals.

2 Claims, 2 Drawing Sheets

ELECTROMAGNETIC MECHANISM

The present applicatio is based on and claims priority under 35 U.S.C § 119 with respect to Japanese Patent application No. 2001-326780 filed on Oct. 24, 2001, the entire content of which is incorporated herein by reference.

FIELD OF THE INVENTION

The present invention relates to an electromagnetic mechanism which is applied to an electromagnetic valve and so on.

BACKGROUND OF THE INVENTION

A conventional electromagnetic mechanism of this kind is disclosed, for example, in Japanese Laid-open Publication No. 2001-143925. This valve includes a case, a coil, a yoke, a connector which is connected to the case, the coil and the yoke, a first terminal which is passed into the connector and a second terminal which is connected to the coil. In this mechanism, the second terminal is disposed in a groove which is formed in the yoke and one end of the first terminal is fitted into the groove so that the first and second terminals are electrically connected each other. However, if the connector is connected to the case and the yoke under the condition that the connector inclines due to the mounting error between the connector and the case, there is danger that electrical connection between the first and second terminals becomes imperfectly.

SUMMARY OF THE INVENTION

It is, therefore, a principal object of the present invention to provide an improved electromagnetic mechanism which overcomes the above drawback.

In order to attain the foregoing object, the present invention provides an electromagnetic mechanism which includes a coil wound on a bobbin made of resin, a case accommodating the coil inside thereof and made of magnetic material, a yoke made of magnetic material and forming a magnetic circuit together with the case, a plunger made of magnetic material and driven by a magnetic attracting force generated at the energization of the coil, a connector formed separately from the bobbin and the case and connected to one end of the case, a first terminal passed into the connector, a second terminal electrically connected to an end of the coil and a urging member made of electric conductor and contacted with the first and second terminals.

BRIEF DESCRIPTION OF THE DRAWINGS

The above and other objects, features and advantages of the present invention will be more apparent and more readily appreciated from the following detailed description of a preferred exemplary embodiment of the present invention, taken in connection with the accompanying drawings, in which.

DETAILED DESCRIPTION OF THE PRESENT INVENTION

Figure 1:
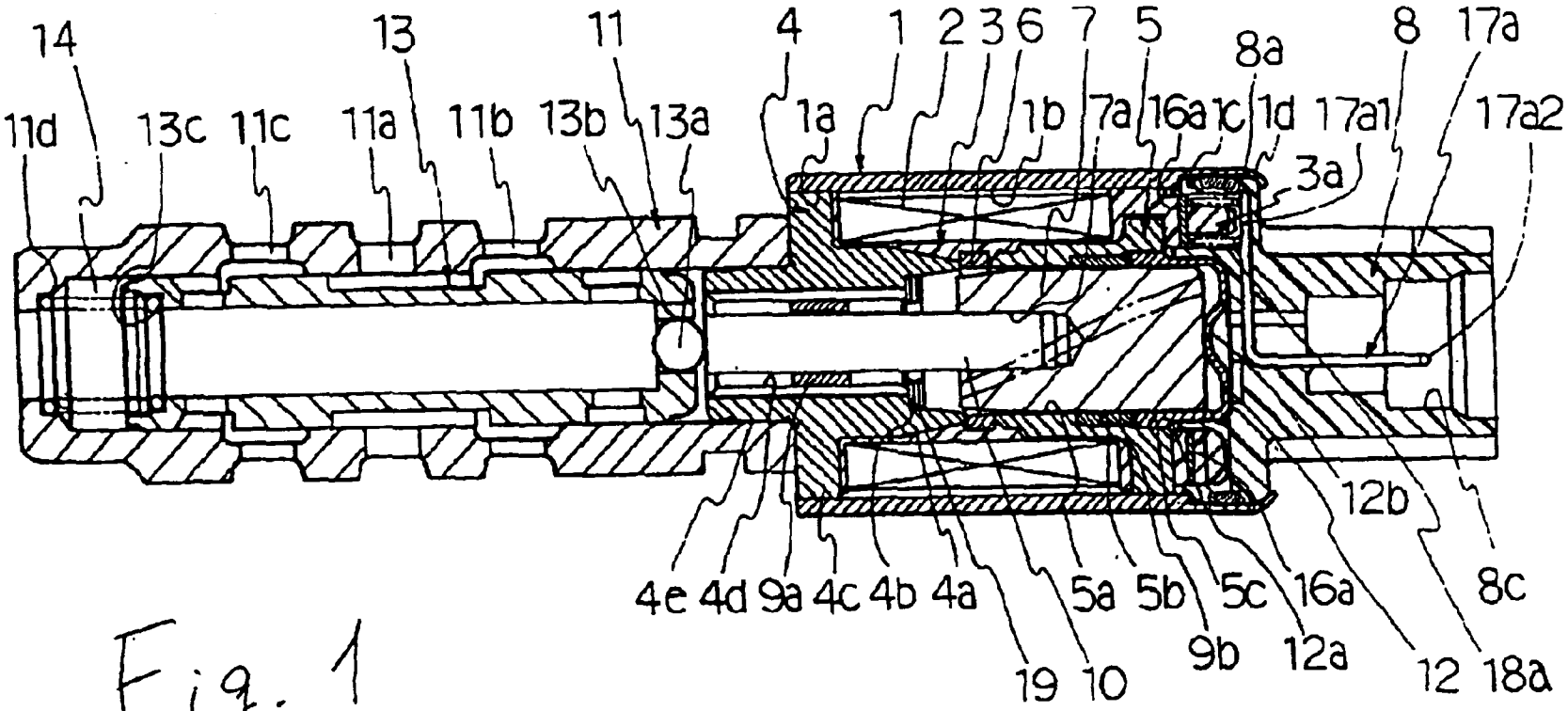
FIG. 1 is a cross sectional view of an electromagnetic mechanism according to an embodiment of the present invention.

FIG. 1 shows an electromagnetic mechanism of the embodiment of the present invention and a sleeve 11 which is connected to the electromagnetic mechanism. In this embodiment, the electromagnetic mechanism controls the movement of a valve member 13 disposed in the sleeve 11 which controls the pressure of the hydraulic oil supplied to pressure chambers (advance angle chambers and retard angle chambers) of a valve timing control device (not shown).

The electromagnetic mechanism includes a case 1 which is made of magnetic material such as iron and which has an approximately cylindrical shape, a coil 2 wound on a bobbin 3 made of resin which is disposed in the case 1, a front yoke 4 and a rear yoke 5 which is located at the bath ends of the bobbin 3 in the axial direction, which is located inward of the bobbin 3 in the radial direction and which is made of magnetic material so as to form a magnetic circuit together with the case 1 and a plunger 7 which is made of magnetic material and which is driven by a magnetic attracting force generated at the energization of the coil 2. A connector 8 which is made of resin and in which a pair of first terminals 17*a* are passed is fitted into the right side end of the case 1 in FIG. 1. The sleeve 11 is connected to the left end of the front yoke 4 in FIG. 1 so as to be coaxial with the front yoke 4. The valve member 13 is slidably disposed in the sleeve 11. A ball 13*a* is fixed to the right end of the valve member 13 in FIG. 1. The ball 13*a* contacts with one end of an output shaft 10 which is pressed into a hole 7*a* formed on one end surface of the plunger 7. A spring 14 is disposed between the left end of the valve member 13 and the bottom portion of the left end of the sleeve 11 and urges the valve member 13, the output shaft 10 and the plunger 7 rightward in FIG. 1.

As shown in FIG. 1, the bobbin 3 is accommodated in a central inner circumference portion 1*b* between one end 1*a* of the left side and the fitting portion 1*c* of the right side of the case 1 in FIG. 1. The inner diameter of the fitting portion 1*c* is slightly larger than that of the central inner circumference portion 1*b*. The connector 8 is fitted into the fitting portion 1*c*. A edge portion 1*d* of the case 1 is bent inward in the radial direction and thereby the connector 8 is fixed to the case 1 by caulking.

The front yoke 4, the rear yoke 5 and a magnetic shielding member 6 are fixed to the bobbin 3 by the insert molding. At the left side and inside of the bobbin 3 in FIG. 1, the front yoke 4 made of iron is disposed. At the right side and inside of the bobbin 3 in FIG. 1, the rear yoke 5 made of iron is disposed. The front and rear yokes 4 and 5 generate magnetic flux at the energization of the coil 2. Further, the magnetic shielding member 6 made of aluminum is disposed between the front yoke 4 and the rear yoke 5 and shields the magnetic flux between the front and rear yokes 4 and 5.

The front yoke 4 includes a corn portion 4*a*, a contacting portion 4*b* which is formed inside of the corn portion 14 as a stepped portion, a flange portion 4*c* which is adjacent to the left side of the corn portion 4*a*, an inner bore 4*d* passing the axial center of the front yoke 4 and a fitting portion 4*e*. The fitting portion 4*e* has an approximately cylindrical shape and a small outer diameter. The corn portion 4*a* has a taper shape so that the magnetic flux is concentrated to the right end in FIG. 1. The contacting portion 4*b* contacts with the left end of the plunger 7 when the plunger 7 is attracted leftward in FIG. 1. A circular spacer 19 for adjusting the stroke of the plunger 7 or output shaft 10 is accommodated in the contacting portion 4*b*. The flange portion 4*c* is pressed into one end 1*a* of the case 1 and is fixed to the case 1. The flange portion 4*c* connect the magnetic circuit from the corn portion 4*a* to the case 1. A circular bush 9*a* made of metal which supports slidably the output shaft 10 is pressed into the inner bore 4*d*. The right end of the sleeve 11 is fixed to the outer circumference of the fitting portion 4*e* by caulking.

The rear yoke 5 includes a sliding portion 5*a*, a fitting portion 5*b* in which a circular bush 9*b* is snugly fitted or pressed and a fitting portion 5*c* to which an opening end 12*a* of a cap 12 is snugly fitted or fitted. The sliding portion 5*a* is located at the inner circumference of the left end of the rear yoke 5 in FIG. 1 and contacts with the plunger 7 so as to be able to slide. The sliding portion 5*a* forms the magnetic circuit which connects from the case 1 to the plunger 7 and the front yoke 4 at the energization of the coil 2. At the fitting portion 5*b* which is formed a the right side of the sliding portion 5*a*, the bush 9*b* made of metal which supports slidably the plunger 7 is pressed into the fitting portion 5*b*. The cap 12 has an approximately cylindrical shape having a bottom portion and contacts with the right end of plunger 7 for stopping the plunger 7. The opening end 12*a* of the cap 12 is pressed into the fitting portion 5*c* and seals so that the hydraulic fluid does not leak outside of the rear yoke 5 and the cap 12. The magnetoresistance of the cap 12 is enlarged by carburizing and quenching and therefore the magnetic flux does not pass the cap 12. Further, since a contacting portion 1*b* which is projected toward the plunger 7 on the bottom surface of the cap 12 is contacted with the plunger 7 by approximately point contact, the cap 12 does not exert the magnetic attracting force to the plunger 7.

The magnetic shielding member 6 is disposed between the front yoke 4 and the rear yoke 5. The magnetic shielding member 6 has large magnetoresistance. Therefore, when the front yoke 4 and the rear yoke 5 are energized, the magnetic circuit does not pass the magnetic shielding member 6 and the magnetic flux passing the rear yoke 5 is headed from the plunger 7 to the front yoke 4.

The plunger 7 is supported in the inner circumferential surface formed by the front yoke 4, the rear yoke 5, the magnetic shielding member 6 and the cap 12 so as to be able to slide. The ball 13*a* which is contacted to the output shaft 10 pressed into the plunger 7 is made of iron and is fixed to the fitting portion 13*b* of the valve member 13. The output shaft 10 and the valve member 13 is arranged so as to press each other through the ball 13*a* and the axial pressing force is transmitted between the valve member 13 and the output shaft 10 without generating a moment even if the valve member 13 and the output shaft 10 are not coaxially disposed. One end of the spring 14 is contacted to the bottom portion 11*d* of the sleeve 11 and the other end of the spring 14 is contacted to the engaging portion 13*c* of the valve member 13. Thereby, the valve member 13 is urged rightward in FIG. 1. The valve member 13 presses the output shaft 10 rightward through the ball 13*a* and thereby the right end of the plunger 7 contacts with the contacting portion 12*b* of the cap 12.

Figure 2:
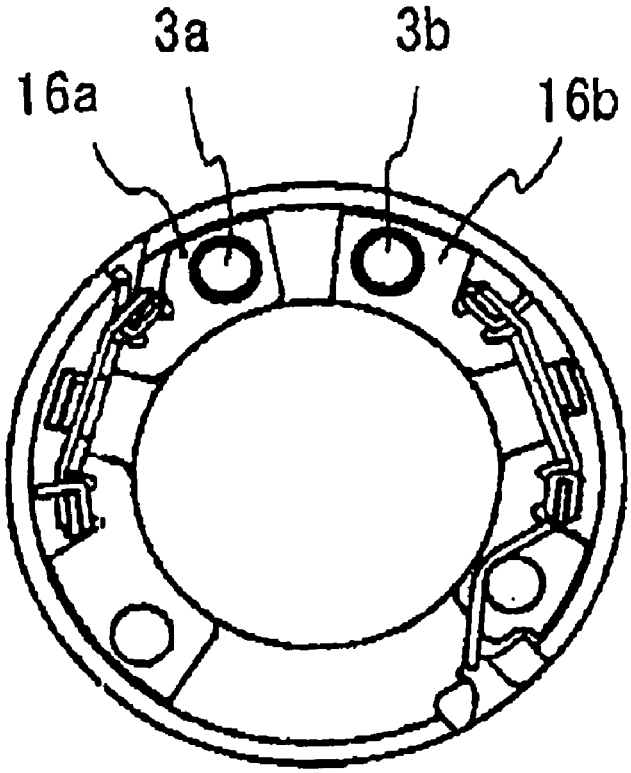
FIG. 2 is a side view of a bobbin according to an embodiment of the present invention.

A pair of passing portions 3*a* are formed on the right end surface of the bobbin 3 in a body. A pair of plate shaped second terminals 16*a*, 16*b* are fitted onto base portion of the passing portions 3*a*. FIG. 2 shows the right end side surface of the bobbin 3 which is in the condition before the connector 8 is fixed to the case 1. The second terminals 16*a*, 16*b* are separated from each other and are electrically insulated from each other. The second terminals 16*a*, 16*b* are electrically connected to both ends of the coil 2, respectively. Each of the second terminals 16*a*, 16*b* has a fitting hole and the passing portions 3*a* are fitted into the fitting hole, respectively. Each of the second terminals 16*a*, 16*b* extends around the passing portions 3*a*, respectively.

Fitting holes 8*a* are formed on the left upper end surface of the connector 8 in FIG. 1. One ends 17*a*1 of a pair of first terminals 17*a* are fixed to the bottom portions of the fitting holes 8*a* and are projected into the fitting holes 8*a*. The first terminals 17*a* pass the connector 8 and the other ends 17*a*2 thereof are projected into a fitting hole 8*c*.

As shown in FIG. 1, the passing portions 3*a*, 3*b* are fitted into the fitting holes 8*a* of the connector B. Coil springs 18*a* which are made of electric conductor such as brass are loosely fitted onto the passing portions 3*a*, 3*b*. Left ends of the coil springs 18*a* contact with the second terminals 16*a*, 16*b* and right ends of the coils springs 18*a* contact with one ends 17*a*1 of the first terminal 17*a* in FIG. 1, respectively. Thereby, the first terminals 17*a* are electrically connected to the second terminals 16*a*, 16*b* through the coil springs 18*a, respectively.*

In this embodiment one ends 17*a*1 of the first terminals 17*a* are electrically connected to the second terminals 16*a*, 16*b* through the coil springs 18*a*.

Thereby, even f the connector 8 is connected to the case 1 under the condition that the connector 8 inclines with respect to the axial direction of the bobbin 3 and the first terminals 17*a* are not parallel with the second terminals 16*a*, 16*b*, the coils springs 18*a* can contact with the first terminals 17*a* and the second terminals 16*a*, 16*b* while absorbing the change of the relative angle between the the first terminals 17*a* and the second terminals 16*a*, 16*b* by the transformation themselves. Accordingly, even if the mounting error between the connector 8 and the case 1 is generated, electrical connection between the first and second terminals 17*a*, 16*a* and 16*b* becomes perfectly.

The electromagnetic mechanism of the embodiment operates as follows. When the electric current is supplied to the first terminals 17*a* and the coil 2 is energized, the front and rear yokes 4 and 5 are energized and the magnetic circuit is formed by the front yoke 4, the case 1, the rear yoke 5 and the plunger 7. As a result, the plunger 7 is attracted toward the front yoke 4 and is moved leftward against the urging force of the spring 14 in FIG. 1. Thereby, the valve member 13 is moved leftward by the output shaft 10 and the communicating relationship between an inlet port 11*a* and an outlet port 11*b* communicated to the retard angle chambers or between the inlet port 11*a* and an outlet port 11*c* communicated to the advance angle chambers is changed. The plunger 7 is urged rightward by the spring 14 through the valve member 13 and the output shaft 10. When the amount of the electric current supplied to the first terminals 17*a* is adjusted, the attracting force applied to the plunger 7 can be adjusted and the position of the valve member 13 relative to the sleeve 11 can be linearly adjusted.

As mentioned above, according to the present invention, even if the mounting error between the connector and the case is generated, the terminal of the connector can be surely connected to the coil electrically.

What is claimed is:

1. A an electromagnetic mechanism comprising:

a coil wound on a bobbin made of resin;

a case accommodating the coil inside thereof and made of magnetic material;

a yoke made of magnetic material and forming a magnetic circuit together with the case;

a plunger made of magnetic material and driven by a magnetic attracting force generated at the energization of the coil;

a connector formed separately from the bobbin and the case and connected to one end of the case;

a first terminal passed into the connector;

a second terminal electrically connected to an end of the coil; and a urging member made of electric conductor and contacted with the first and second terminals, wherein said bobbin has a plurality of hollow portions on a right end surface with passing portions formed inside said plurality of hollow portions;

wherein said yoke has a front yoke and a rear yoke, said rear yoke comprising a sliding portion, a first fitting portion with a circular brush and a second fitting portion, and wherein said plunger is fitted into said first fitting portion.

2. An electromagnetic mechanism as set forth in claim 1, wherein one end of the first terminal is opposite to the second terminal and is parallel with the second terminal, and wherein the urging member is a coil spring which is disposed between one end of the first terminal and the second terminal which urges one end of the first terminal and the second terminal so as to separate from each other.

* * * * *